US005437434A

United States Patent [19]

Ao et al.

[11] Patent Number: 5,437,434

[45] Date of Patent: Aug. 1, 1995

[54] METHOD OF PREVENTING GENERATION OF EARTH CIRCULATING CURRENT IN INDUCTION HEATING APPARATUS FOR MOLTEN STEEL

[75] Inventors: Yoji Ao; Isao Tokuda, both of Futtsu; Minoru Honda, Kitakyushu, all of Japan

[73] Assignee: Nippon Steel Corporation, Tokyo, Japan

[21] Appl. No.: 276,800

[22] Filed: Jul. 18, 1994

[51] Int. Cl.[6] ..... B22D 41/01

[52] U.S. Cl. ..... 266/44; 266/242; 266/275; 222/593

[58] Field of Search ..... 266/44, 234, 236, 237, 266/242, 275; 222/590, 592, 593

[56] References Cited

U.S. PATENT DOCUMENTS

| | | | |
|---|---|---|---|
| 2,610,218 | 9/1952 | Lang | 266/234 |
| 4,441,191 | 4/1984 | Fredrikson et al. | 373/161 |
| 5,032,177 | 7/1991 | Jochem et al. | 266/237 |

FOREIGN PATENT DOCUMENTS

| | | | |
|---|---|---|---|
| 2427864 | 4/1979 | France . | |
| 734890 | 6/1943 | Germany . | |
| 0185556 | 10/1984 | Japan | 222/593 |
| 4172155 | 6/1992 | Japan | 266/234 |

OTHER PUBLICATIONS

Patent Abstracts of Japan, vol. 12, No. 325 (M-737) 5 Sep. 1988 & JP-A-63 093 455 (Nippon Steel Corp.) 23 Apr. 1988.

Patent Abstracts of Japan, vol. 10, No. 196 (M-497) 10 Jul. 1986 & JP-A-61 038 754 (Nippon Steel Corp.) 24 Feb. 1986.

Patent Abstracts of Japan, vol. 6, No. 150 (M-148) 10 Aug. 1982 & JP-A-57 070 066 (Kawasaki Steel Corp.) 30 Apr. 1982.

*Primary Examiner*—Scott Kastler

*Attorney, Agent, or Firm*—Pollock, Vande Sande & Priddy

[57] ABSTRACT

There is disclosed a method by which a channel-type induction heating apparatus is provided on a tundish, which comprises a steel receiving chamber and a steel discharging chamber separated by a refractory wall, each of which chambers is connected to the ground via molten steel flowing from a ladle, molten steel flowing into a mold, or a refractory, in such a manner that ground circulating current is prevented from being generated. An electromagnetic connection of an induction heating coil and an iron core of a two-leg type or a three-leg type to a loop current circuit in the molten steel is arranged symmetrically, thereby suppressing the generation of the ground circulating current. By thus suppressing the generation of the ground circulating current, it becomes unnecessary to insulate a ground circuit as required in conventional constructions, the maintenance of facilities becomes easier, besides any malfunction of the equipment due to the ground circulating current is totally eliminated.

7 Claims, 5 Drawing Sheets

METHOD OF PREVENTING GENERATION OF EARTH CIRCULATING CURRENT IN INDUCTION HEATING APPARATUS FOR MOLTEN STEEL

BACKGROUND OF THE INVENTION

This invention relates to a method of preventing the generation of a ground circulating current in an induction heating apparatus for molten steel in a tundish in a continuous casting operation.

Superheating temperatures (hereinafter referred to as "SH") of molten steel in a tundish in a continuous casting operation (see FIG. 6) greatly influence the quality of a steel product. If SH is high, this interrupts equiaxis crystallization, and increases central segregation. If SH is low, the viscosity of the molten steel increases, and defects due to inclusions frequently occur, for example, as a result of generation of deckel (i.e., agglomerates formed by inclusions or powder deposited on the molten steel) in a mold. Therefore, it is desirable from the viewpoint of the quality that SH should always be controlled to a target range. Generally, however, when trying to keep SH constant in a charge under the influence of heat dissipation from the molten steel in a ladle, the casting speed must be varied. This has resulted in a problem that the efficiency of the production is lowered, and besides the lowering of SH at a final stage of the casting operation could not be sufficiently compensated for.

Under the circumstances, there has now been made an attempt in which a heating function is added to a tundish for continuous casting to prevent the lowering of SH at an initial stage and a final stage of the casting operation. For heating molten steel in a tundish, it is a common practice to use an electrically-operated induction heating system in view of HS controllability and economy.

A commonly-used induction heating apparatus will now be described with reference to FIG. 4. Reference numeral 1 denotes a two-leg iron core. A tundish 20 is enclosed by an iron shell 13 and is lined with a refractory. This tundish is divided into first and second chambers 6 and 7 which communicate with each other by molten steel channels 14 and 15. The first and second chambers 6 and 7 are separated from each other by a refractory wall 4, and one leg of the two-leg iron core 1 extends through a central portion of the refractory wall 4, and a coil 2 is wound on the one leg of the two-leg iron core 1. A loop current circuit is formed through molten steel 5 around the two-leg iron core 1 (which constitutes a closed magnetic field circuit) through the molten steel channels 14 and 15 (which are provided to interlink the two-leg iron core 1) within the tundish 20. A ground circuit 18 serves to effect grounding via the molten steel, the refractory and the associated equipment from the first chamber 6, and a ground circuit 19 serves to effect grounding via the molten steel, the refractory and the associated equipment from the second chamber 7. Molten steel is supplied from a ladle 9 (FIG. 6) into the first chamber 6, and the molten steel is fed from the second chamber 7 into a continuous casting mold 11 through a submerged entry nozzle.

The condition of the molten steel in the tundish and the ladle, the condition of the molten steel discharged to the mold, and electric circuits will now be described with reference to FIG. 5 which is a perspective view.

In this case, the molten steel receiving chamber (first chamber) 6 of the tundish 20 is electrically connected to the ladle 9 via the molten steel or a long nozzle 8, and the ladle 9 is connected to the earth 18 via a ladle support. The molten steel discharging chamber (second chamber) 7 is connected to the mold 11 or a pinch roll 12 via the molten steel or an immersion nozzle 10, and the mold 11 or the pinch roll 12 is connected to the ground 19.

In FIG. 5, it can be considered that the electric circuits are a loop 25 via the molten steel, a loop 17 via the iron shell of the tundish (the loop 17 being formed in iron shell 13), and a ground circuit 16. In FIG. 5, reference numeral 13 denotes the iron shell of the tundish, and reference numeral 1 denotes the two-leg iron core.

Rz: Iron shell insulating plate ($Rz>0\Omega$)

Rx: LD (ladle) earth resistance (Rx=several tens of $m\Omega$)

$R_1$: LN (long nozzle) refractory resistance ($R_1>0\Omega$)

Rs: PR (pinch roll) resistance (Rs=several tens of $m\Omega$)

Here, the ground circuit 16 is to be considered.

An earth circulating current flows through this ground circuit 16, and problems, such as red heat and electrolytic corrosion of the equipment, have often been encountered.

In FIG. 4, when the first chamber 6 and the second chamber 7 are connected to the ground, an electric circuit serving as a ground circuit (indicated by a broken line) is formed in addition to a molten steel-heating circuit (indicated by a solid line) which is an originally-intended function, and a ground circulating current flows therein. To avoid this circulating current, there has been used a method of insulating the ground circuit; however, this has required much time and labor for the maintenance of the facilities.

SUMMARY OF THE INVENTION

It is therefore an object of this invention to provide a method which essentially suppresses the generation of a ground circulating current, thereby obviating the need for insulation of the facilities.

According to the first aspect of present invention, there is provided a method of substantially preventing occurrence of circuitating electric current while induction-heating a molten steel to control a temperature of the molten steel received in a tundish used in continuous casting apparatus and adapted to feed the molten steel to mold means of the continuous casting apparatus. The tundish comprises a molten steel-receiving chamber, a molten steel-discharging chamber, electrical ground circuit means provided for each of the chambers, electromagnetic induction heating means for heating the molten steel received in the tundish which heating means is provided with iron core having at least two legs and at least one coil means surrounding the at least one of the legs to thereby form a closed magnetic circuit in the iron core, and at least two channels each operatively connecting both of the molten steel-receiving and molten steel-discharging chambers, each of which channels is interlinked with the iron core to thereby form a loop current circuit in the molten steel. The method comprises the steps of disposing the channels substantially symmetrically with respect to the iron core so that an electro-magnetic connection between the iron core and the channels is made to be substantially symmetrical with respect to the iron core to thereby make an electrical potential of the molten steel-receiving chamber substantiall equal to that of the molten steel-discharging chamber, and induction-heating the molten steel received in the tundish through the induction heating means, whereby the circulating current is substantially prevented from occurring in the ground circuit means while the chambers are electrically grounded through the ground circuit means during the induction-heating of the molten steel.

According to the second aspect of the present invention, there is provided a tundish for feeding a molten steel which tundish is to be used in continuous casting apparatus to feed the molten steel to mold means of the continuous casting apparatus. It comprises a molten steel-receiving chamber, a molten steel-discharging chamber, electrical ground circuit means provided for each of the chambers, electromagnetic induction heating means for heating the molten steel received in the tundish which heating means is provided with iron core having at least two legs and at least one coil means surrounding at least one of the legs to thereby form a closed magnetic circuit in the iron core, and at least two channels each operatively connecting both of the molten metal-receiving and molten steel-discharging chambers each of which channels is interlinked with the iron core to thereby form a loop current circuit in the molten steel, the channels being disposed to be symmetrical with respect to the iron core so that an electrical potential of the molten steel-receiving chamber is substantiall equal to that of the molten steel-discharging chamber to thereby substantially prevent a circulating current from occurring in the ground circuit means while the chambers are electricaly grounded through the ground circuit means during the induction-heating of the molten steel.

DESCRIPTION OF THE PREFERRED EMBODIMENTS

Example 1

Figure 1A:
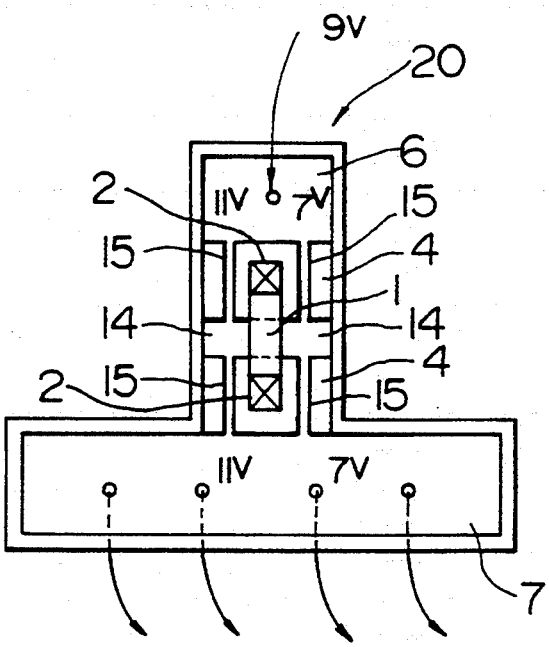
FIG. 1A is a view of an induction heating apparatus for performing a method of the present invention.

The present invention will now be described with reference to FIG. 1A. An induction heating apparatus for molten steel in a tundish for continuous casting is shown in this FIG. the induction heating apparatus employing a two-leg iron core. Reference numeral 6 denotes a steel receiving chamber, and reference numeral 7 denotes a steel discharging chamber. Both legs of the two-leg iron core 1 extend through the tundish with refractory walls 4 provided between the steel receiving chamber 6 and the steel discharging chamber 7, thereby forming a closed magnetic field circuit. Both legs of the core 1 extend through a coil 2.

Figure 1B:
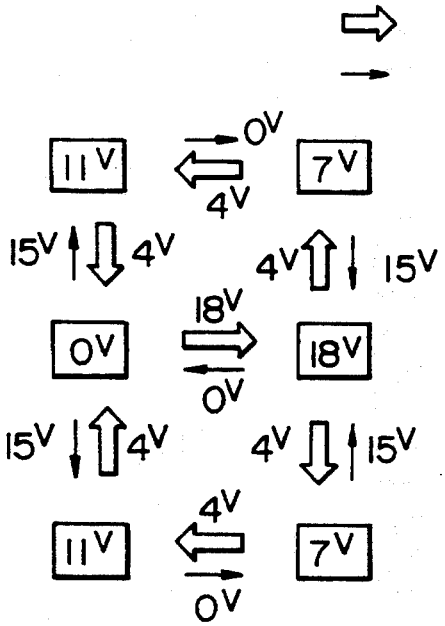
FIG. 1B is an illustration showing an example of calculation of an electric potential distribution of the induction heating apparatus.

Channels 15 are symmetrically provided respectively on opposite sides of the closed magnetic field circuit in parallel relation to each other. A channel 14 interlinking the two-leg iron core 1 is symmetrically connected to the channels 15 in interlinking relation thereto. An example of calculation of an electric potential distribution of this induction heating apparatus is shown in Fig. 1B, wherein a mark " " represents an electromotive force, and another mark "→" represents a voltage drop. The potentials of the steel receiving chamber, and the steel discharging chamber become 9 V and 11~7 V, respectively, and even when the steel receiving chamber and the steel discharging chamber are connected to the earth, a potential difference between the two chambers is close to 0 V, so that substantially no circulating current occurs.

Example 2

Figure 2A:
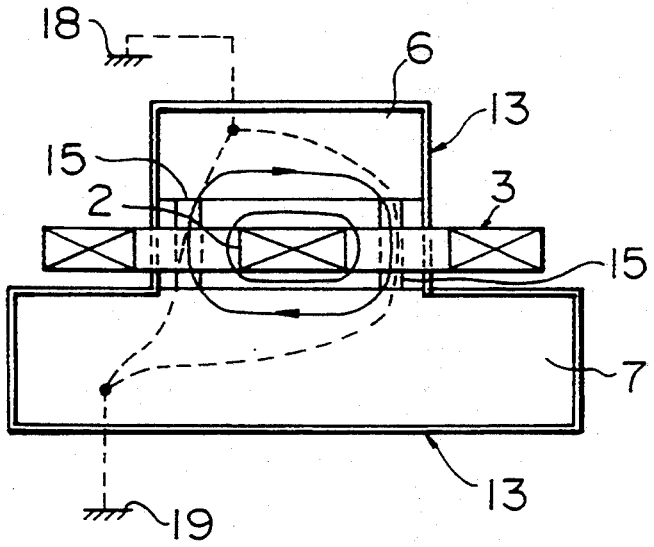
FIG. 2A is a view of a modified induction heating apparatus for performing a method of the present invention.

As shown in FIG. 2A, molten steel channels 15 are provided in a refractory wall 4 separating a steel receiving chamber 6 and a steel discharging chamber 7 from each other, and are disposed symmetrically with respect to a central leg of a three-leg iron core 3. A circuit formed by the three-leg iron core 3 interlinks the molten steel channels 15. With this arrangement of the molten steel channels 15, a uniform induced electromotive force is produced in the molten steel channels 15, so that the electric potential of the molten steel in the steel receiving chamber 6 is equal to the electric potential of the molten steel in the steel discharging chamber 7. Therefore, even when the steel receiving chamber 6 and the steel discharging chamber 7 are connected to the ground, substantially no circulating current occurred since a potential difference between the two chambers was close to 0 V.

Figure 2B:
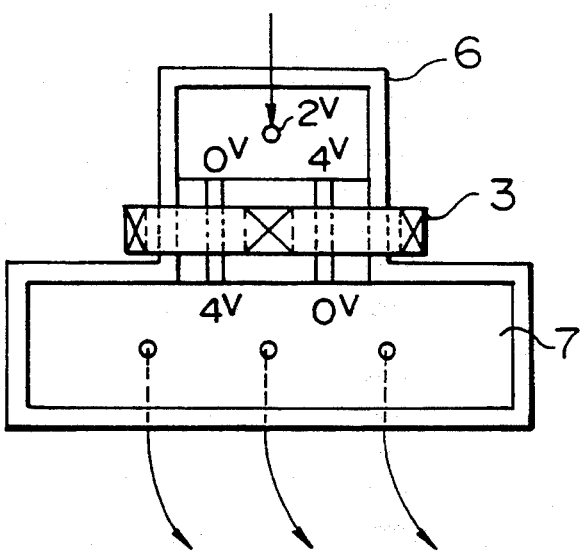
FIG. 2B is a view showing an electric potential distribution of the induction heating apparatus of FIG. 2A.

FIG. 2B shows an example of calculation of a potential distribution, and 2 V or 4~0 V is obtained regarding the potential of each of the steel receiving chamber and the steel discharging chamber, and a circulating current hardly flows.

Example 3

Figure 3:
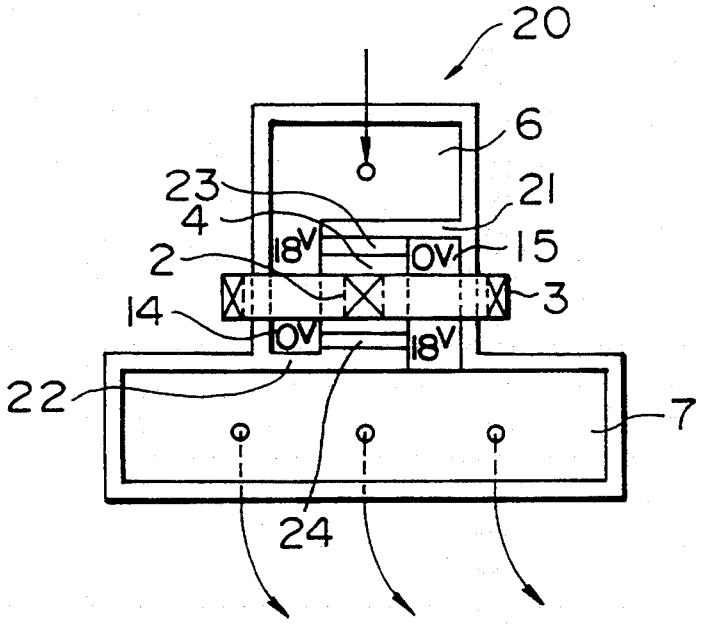
FIG. 3 is a view showing another modified induction heating apparatus for performing a method of the present invention, and an electric potential distribution thereof.
Figure 4:
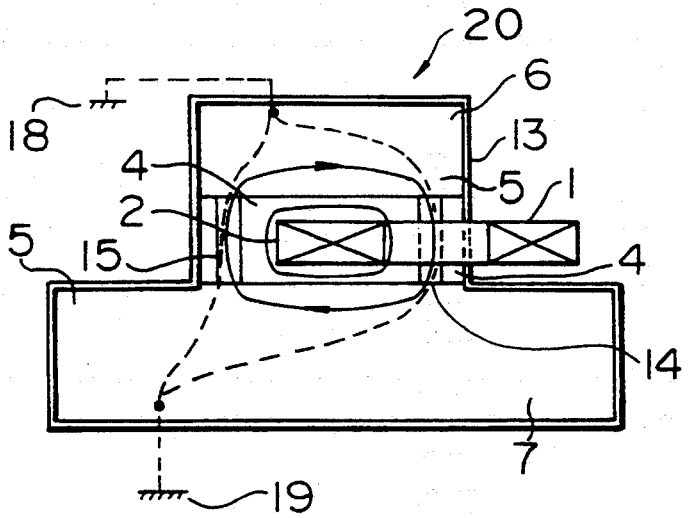
FIG. 4 PRIOR ART
FIG. 4 is a view explanatory of a conventional induction heating apparatus.
Figure 5:
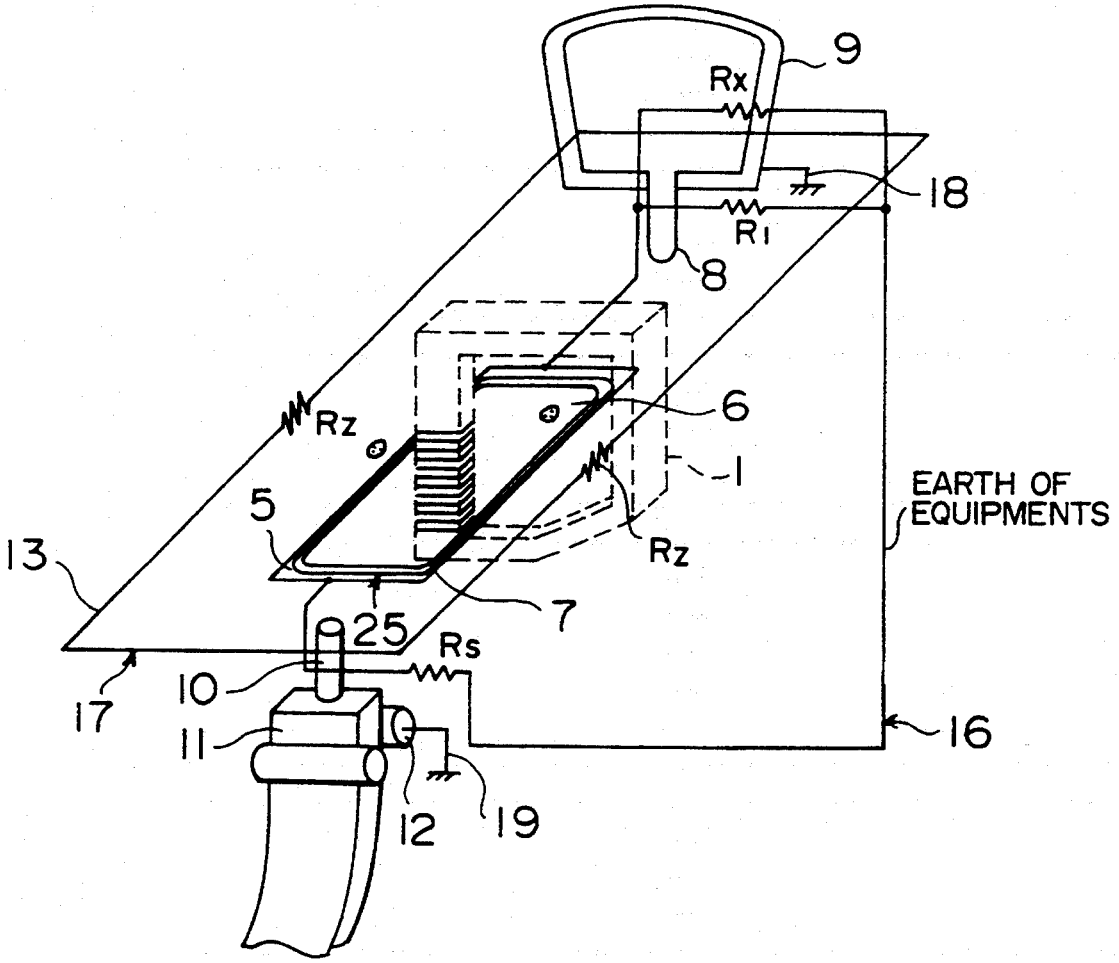
FIG. 5 PRIOR ART
FIG. 5 is a view showing the manner of using a conventional induction heating apparatus.
Figure 6:
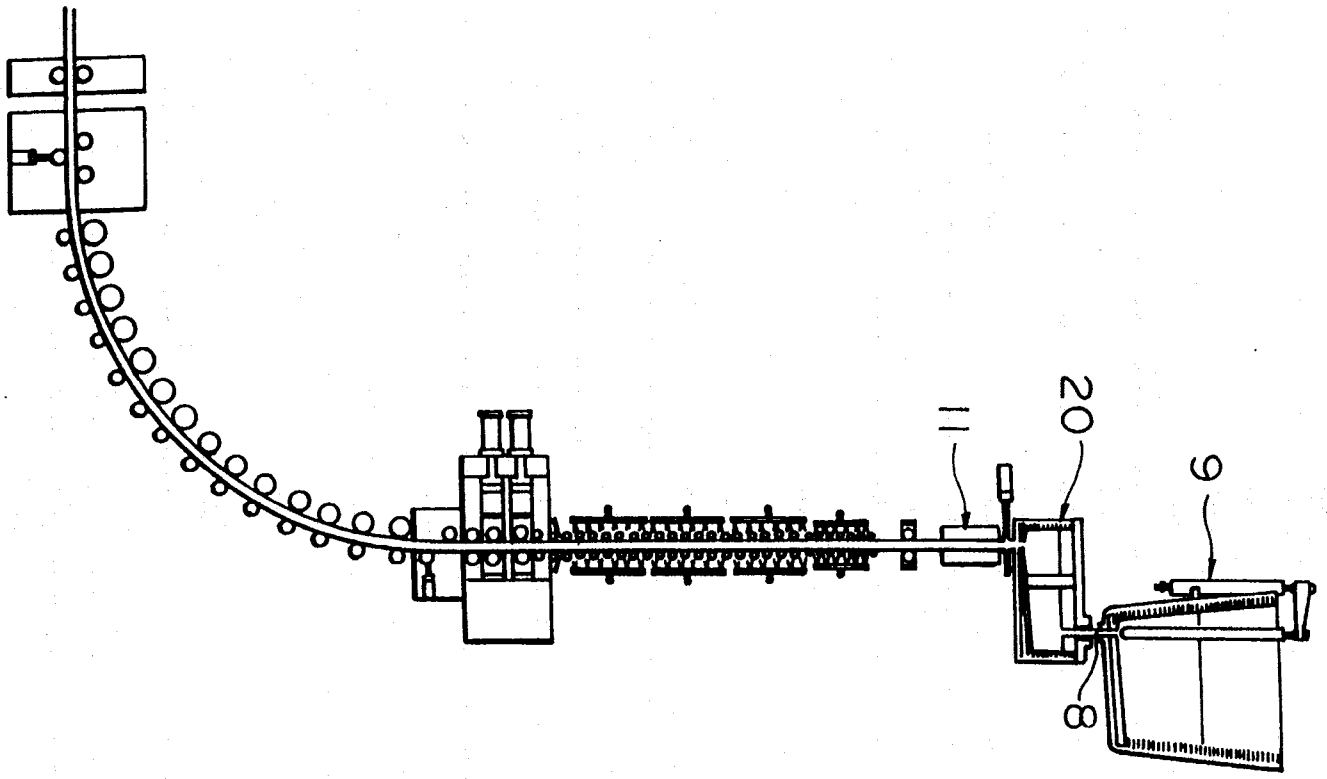
FIG. 6 is a schematic view showing continuous casting apparatus in which a tundish embodying the invention is used.

In FIG. 3, a central leg of a three-leg iron core 3 extends through a tundish with refractory walls 4 separating a steel receiving chamber 6 and a steel discharging chamber 7 from each other, and a coil 2 is wound around this central leg of the three-leg iron core to form a three-leg iron core circuit. Molten steel channels 14 and 15, interlinking the three-leg iron core circuit, are symmetrically provided in the refractory wall 4. The molten steel channel 15 is closed by a receiving steel chamber weir 21, and the molten steel channel 14 is closed by a steel discharging chamber weir 22. The molten steel channels 14 and 15 communicate with each other by molten steel channels 23 and 24 which are symmetrically provided respectively on opposite sides of the three-leg iron core circuit.

FIG. 3 shows an example of calculation of a potential distribution, and 18 V versus 18 V is obtained regarding the potentials of the steel receiving chamber 6 and the steel discharging chamber 7, and substantially no circulating current flowed.

As described above, in the type of tundish in which there are provided the steel receiving chamber and the steel discharging chamber, and these chambers are connected to the ground via the molten steel from a ladle, the molten steel flowing into a mold, or the refractory, the electrical connection between the iron core and the molten steel channels is arranged symmetrically, and with this arrangement the electric potential of the steel receiving chamber is made equal to the electric potential of the steel discharging chamber, so that even when the steel receiving chamber and the steel discharging chamber are connected to the ground, the generation of a circulating current can be substantially prevented.

In conventional constructions, a ground circuit has been formed, and countermeasures, such as means for insulating a ground circulating current circuit, have been adopted. However, with the method of the present invention, a ground circulating current in the ground circuit is suppressed, so that any malfunction of the associated equipment is totally eliminated.

What is claimed is:

1. A method of substantially preventing the occurrence of circulating electric current while induction-heating a molten steel to control its temperature said molten steel being received in a tundish used in continuous casting apparatus and adapted to feed said molten steel to mold means of said continuous casting apparatus, said tundish comprising a molten steel-receiving chamber, a molten steel-discharging chamber, electrical ground circuit means provided for each of said chambers, refractory wall means for separating the chambers from each other, electromagnetic induction heating means for heating said molten steel received in the tundish which heating means is provided with iron core having at least two legs and at least one coil surrounding at least one of said legs to thereby form a closed magnetic circuit in said iron core and which heating means is at least partly located within the refractory wall means, and at least two channels each operatively connecting both of said molten steel-receiving and molten steel-discharging chambers, each of which channels interlinked with the iron core to thereby form a loop current circuit in the molten steel, said method comprising the steps of disposing said channels substantially symmetrically with respect to the iron core while extending said at least one leg of the iron core through said tundish so that an electromagnetic connection between said iron core and said channels is substantially symmetrical with respect to said iron core to thereby make an electrical potential of said he molten steel-receiving chamber substantially equal to that of the molten steel-discharging chamber, and induction-heating said molten steel received in said tundish through said induction heating means, whereby substantially preventing occurrence of said circulating current in said ground circuit means when said chambers are electrically grounded through said ground circuit means during the induction-heating of the molten steel.

2. A method of substantially preventing the occurrence of circulating electric current as claimed in claim 1, wherein said iron core is provided with two legs aligned in parallel to and between first and second channels each communicating the molten steel-receiving chamber with the molten steel-discharging chamber, said two legs being interlinked with other molten steel channel connecting said first and second channels to each other, the coil means surrounding each of said two legs.

3. A method of substantially preventing the occurrence of circulating electric current as claimed in claim 1, wherein said iron core is provided with three legs aligned in a vertical direction with respect to first and second channels each operatively connecting the molten steel-receiving chamber with the molten steel-discharging chamber, a central leg of said three legs being disposed between the molten steel-receiving chamber and the molten steel-discharging chamber and between said first and second channels, other two legs being disposed outwardly of iron shell defining the molten steel-receiving chamber and the molten steel-discharging chamber, said coil means surrounding said central leg.

4. A tundish for feeding a molten steel and used to feed said molten steel to mold means of a continuous casting apparatus, the tundish comprising: a molten steel-receiving chamber, a molten steel-discharging chamber, electrical ground circuit means provided for each of said chambers, refractory wall means for separating the chambers from each other, electromagnetic induction heating means for heating said molten steel received in the tundish which heating means is provided with iron core having at least two legs and at least one coil surrounding at least one of said legs to thereby form a closed magnetic circuit in said iron core and which heating means is at least partly located within the refractory wall means, and at least two channels each operatively connecting said molten steel-receiving and molten steel-discharging chambers, each of which channels being interlinked with the iron core to thereby form a loop current circuit in the molten steel, the method comprising the steps of disposing the channels substantially symmetrically with respect to the iron core while extending said at least one leg of the iron core through said tundish so that an electromagnetic connection between said iron core and said channel is substantially symmetrical with respect to said iron core to thereby make an electrical potential of said molten steel-receiving chamber substantially equal to that of said molten steel-discharging chamber, and induction-heating said molten steel received in said tundish through said induction heating means, whereby substantially preventing occurrence of said circulating current in said ground circuit means when said chambers are electrically grounded through said ground circuit means during the induction-heating of the molten steel.

5. A tundish for feeding a molten metal as claimed in claim 4, wherein said induction heating means is disposed between the molten steel-receiving chamber and the molten steel-discharging chamber, and said coil means is spaced from the molten steel by refractory walls.

6. A tundish for feeding a molten steel as claimed in claim 5, wherein said iron core is provided with two legs aligned in parallel to and between first and second channels each communicating the molten steel-receiving chamber with the molten steel-discharging chamber, said two legs being interlinked with other molten steel channel connecting said first and second channels to each other, said coil means surrounding each of said two legs.

7. A tundish for feeding a molten metal as claimed in claim 4, wherein said iron core is provided with three legs aligned in a vertical direction with respect to first and second channels each operatively connecting the molten steel-receiving chamber with the molten steel-discharging chamber, a central leg of said three legs being disposed between the molten steel-receiving chamber and the molten steel-discharging chamber and between said first and second channels, other two legs being disposed outwardly of iron shell defining the molten steel-receiving chamber and the molten steel-discharging chamber, said coil means surrounding said central leg.

* * * * *